US005872544A

United States Patent [19]

Schay

[11] Patent Number: 5,872,544

[45] Date of Patent: Feb. 16, 1999

[54] CELLULAR ANTENNAS WITH IMPROVED FRONT-TO-BACK PERFORMANCE

[75] Inventor: Gary A. Schay, Stony Brook, N.Y.

[73] Assignee: GEC-Marconi Hazeltine Corporation Electronic Systems Division, Greenlawn, N.Y.

[21] Appl. No.: 794,705

[22] Filed: Feb. 4, 1997

[51] Int. Cl.[6] ..... H01Q 21/24

[52] U.S. Cl. ..... 343/727; 343/725; 343/770; 343/793; 343/872; 343/834

[58] Field of Search ..... 343/725, 727, 343/729, 730, 810, 817, 890, 891, 892, 767, 770, 771, 793, 794, 872, 819, 832, 834, 835

[56] References Cited

U.S. PATENT DOCUMENTS

| | | | |
|---|---|---|---|
| 4,119,970 | 10/1978 | Bogner et al. | 343/770 |
| 4,129,871 | 12/1978 | Johns | 343/771 |
| 4,141,012 | 2/1979 | Hockham et al. | 343/725 |
| 4,247,858 | 1/1981 | Eichweber | 343/729 |
| 4,899,165 | 2/1990 | Schadler | 343/727 |
| 4,907,008 | 3/1990 | Dienes | 343/727 |
| 5,654,722 | 8/1997 | Lundback et al. | 343/727 |

FOREIGN PATENT DOCUMENTS

| | | |
|---|---|---|
| 0521 326A | 1/1993 | European Pat. Off. . |
| WO90/10959 | 9/1990 | WIPO . |

*Primary Examiner*—Don Wong
*Assistant Examiner*—Tho Phan
*Attorney, Agent, or Firm*—Edward A. Onders; Kenneth P. Robinson

[57] ABSTRACT

A 90 degree azimuth beamwidth is achieved in a narrow cellular antenna, by inclusion of sidewalls. To improve front-to-back performance, slot radiating elements extending through the sidewalls re-radiate signals behind the antenna. Signals re-radiated from the slot elements are effective to partially cancel signals otherwise radiated behind the antenna as a result of diffraction. H-shaped slots are described for sidewall use and side-to-side slots are described for endwall use. Slots may be dielectrically loaded by contiguous portions of a radome.

22 Claims, 5 Drawing Sheets

CELLULAR ANTENNAS WITH IMPROVED FRONT-TO-BACK PERFORMANCE

RELATED APPLICATIONS (Not Applicable)

FEDERALLY SPONSORED RESEARCH (Not Applicable)

BACKGROUND OF THE INVENTION

This invention relates to array antennas suitable for cellular use and, more particularly, to such antennas employing a single column of dipoles with inclusion of slot radiating elements extending through a reflector to re-radiate behind the antenna, providing signal cancellation to improve front-to-back performance.

With the expansion of cellular and other wireless communication services, there is a growing requirement for antennas suitable for communication with cellular telephones and other mobile user equipment. These antennas are typically provided in fixed installations on buildings or other structures in urban and other areas. The characteristic of the use of a large number of contiguous cell coverage areas of relatively small size, particularly in urban installations, results in the need for installation of large numbers of antennas. The need to provide reliable communications service to a population of users moving through coverage areas with varying transmission characteristics places special requirements on the antennas.

While many types of antennas are available for these applications, where narrower beamwidths are required prior antenna designs have typically resulted in antennas of undesirable size, particularly as to reflector width, or antenna front-to-back thickness, or both. For example, where it is desirable to provide a 90 degree azimuth beamwidth by use of a single vertical column of dipoles, a relatively wide and/or thick antenna construction has typically been necessary, in order to achieve the desired beamwidth while limiting back radiation (e.g., achieving a front-to-back ratio of the order of 25 dB). For a 90 degree beamwidth, prior art techniques may typically result in an antenna 12 inches wide and 12 inches deep.

Thus, while desired operating characteristics may be achieved in prior antennas by combinations of a wide reflector behind a stack of active and cooperative inactive elements, for example, optimum size reduction is not achieved. Antenna size is a significant consideration with respect to overall obtrusiveness of antenna installations, as well as wind loading, weight, etc. As will be appreciated, larger antennas result in increased wind loading forces, increased weight, increased lateral space requirements where a plurality of antennas are mounted at one site, etc. Greater requirements as to structural strength and capacity potentially increase the size and cost of towers and other antenna mount structures.

Objects of the invention are, therefore, to provide new and improved cellular antennas and such antennas characterized by one or more of the following:

- improved front-to-back performance,
- use of slot radiating elements extending through reflector portions,
- cancellation of signals otherwise radiated behind an antenna, and
- narrow reflector width, while achieving desired performance characteristics, such as front-to-back ratio.

SUMMARY OF THE INVENTION

In accordance with the invention, a cellular antenna, providing an azimuth beamwidth and having improved front-to-back performance, includes a plurality of vertically aligned dipole radiators in a single vertical column. A reflective backwall of planar rectangular shape is positioned behind the dipole radiators. The backwall has a width inadequate to provide sufficient focusing to achieve the desired azimuth beamwidth. Sidewalls of planar rectangular shape and extending forward from the backwall are included to increase beam focus to achieve the desired azimuth beamwidth. The antenna further includes a plurality of H-shaped slot radiating elements extending through the sidewalls to re-radiate signals behind the antenna to improve front-to-back performance by partially canceling signals otherwise radiated behind the antenna. The antenna may also include a radome of dielectric material having side portions extending contiguous to the slot radiating elements and partially determining effective slot capacitance.

A cellular antenna in accordance with the invention may additionally include endwalls extending forward from the top and bottom of the backwall and slot radiating elements extending through the endwalls to re-radiate signals behind the antenna to provide back radiation cancellation.

For a better understanding of the invention, together with other and further objects, reference is made to the accompanying drawings and the scope of the invention will be pointed out in the accompanying claims.

DESCRIPTION OF THE INVENTION

The invention will be described in the context of the antenna illustrated in FIGS. 1A, 1B and 1C. The illustrated antenna is more completely described in application Ser. No. 08/518,059, filed Aug. 22, 1995, and commonly assigned with the present application. The referenced application, in its entirety, is hereby incorporated by reference herein. The present invention will be more particularly described under the heading referring to FIGS. 4–6.

Figures 1, 1A:
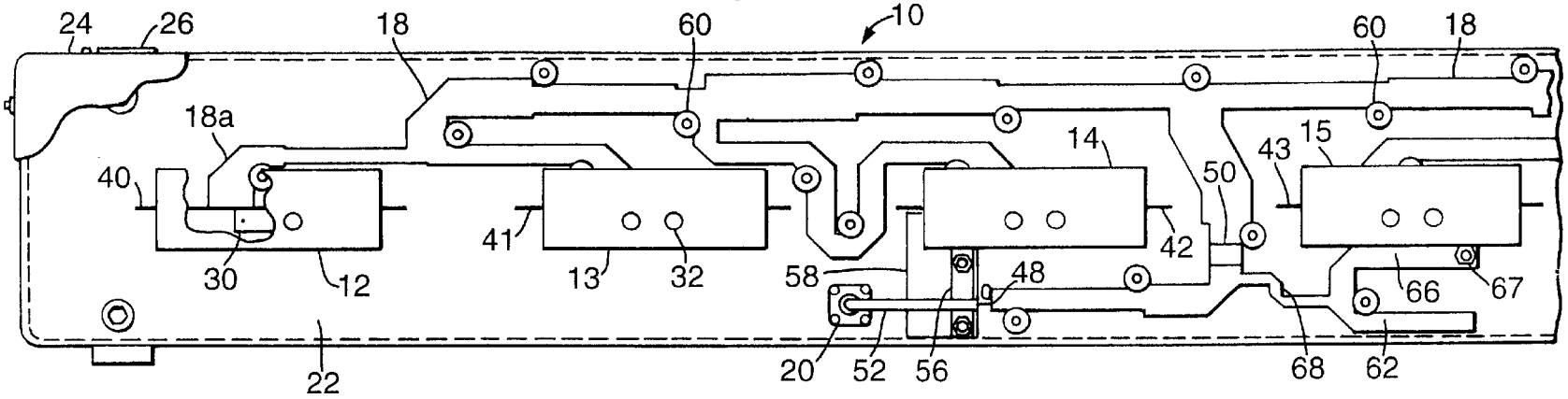
FIGS. 1A (including partial views 1A-1, and 1A-2), 1B and 1C are respectively plan, partial side, and end views of a dipole array antenna including an electromagnetic exciter feed radiating/receiving unit.
Figures 1, 1A, 2:
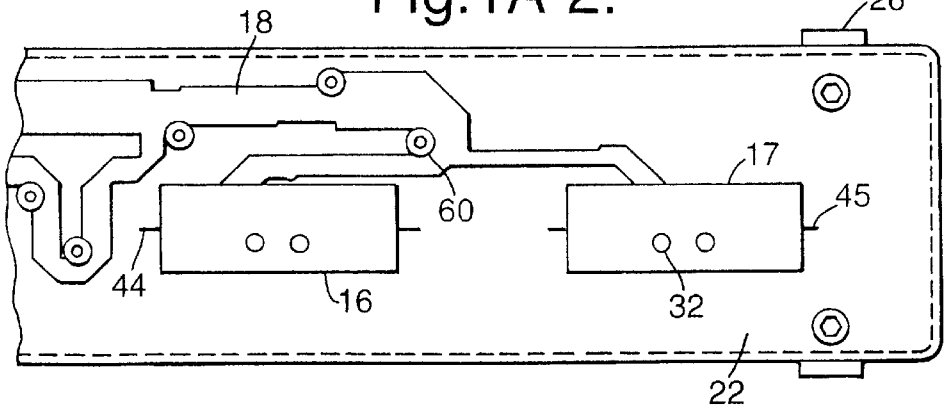
Figure 1B:
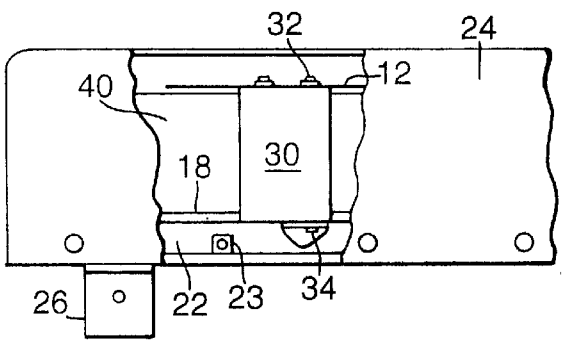
Figure 1C:
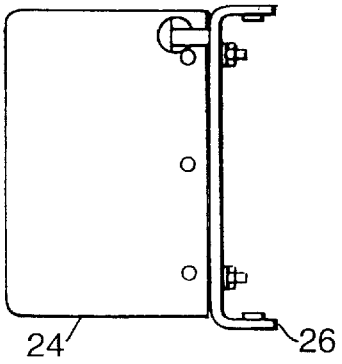

FIGS. 1A, 1B and 1C are plan, partial side and end views, respectively, of an electromagnetic exciter feed dipole array antenna 10. As visible in FIG. 1A, the antenna includes six rectangular dipole radiators 12, 13, 14, 15, 16 and 17, typically cut from thin aluminum stock, which form a linear array. Also visible in FIG. 1A is the signal distribution portion 18 of a microstrip feed assembly, arranged to feed dipole radiators 12–17 in parallel from an electrical connector 20. As shown, connector 20 is mounted to a ground plane unit 22, typically formed of aluminum stock. The microstrip line sections of signal distribution portion 18, typically cut from brass stock, are supported in an air insulated configuration above the upper surface of ground plane unit 22.

Before describing the radiating system components in greater detail, other features of the antenna as shown in FIGS. 1A, 1B and 1C can be noted. As shown, the ground plane unit has a main planar surface, with side and end edge portions bent down to form a structural unit. A dielectric radome 24, partially cut away, is attached by screws or other fasteners to the edge portions at fastener points 23 and extends over the radiating system components. Structural brackets 26 of suitable construction for mounting the antenna 10 in a vertical operational orientation are attached to the underside of ground plane unit 22, at each end. Many structural variations may be employed. For example, embodiments constructed for different beam width characteristics include a ground plane unit with side and end edge portions bent up, rather than down.

Figure 2A:
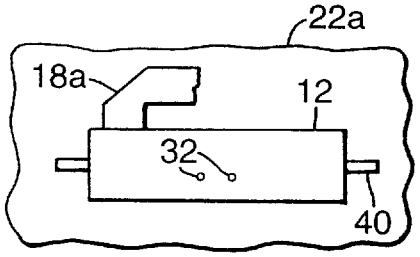
FIGS. 2A, 2B and 2C are simplified plan, side and end views of one double-tuned electromagnetic exciter feed radiating/receiving unit of the FIG. 1A antenna.
Figure 2B:
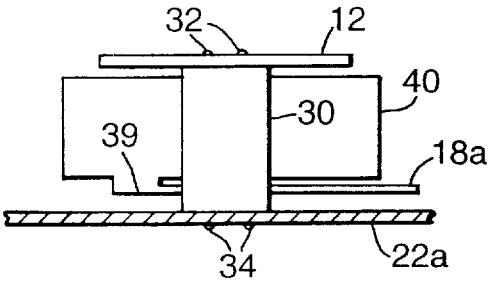
Figure 2C:
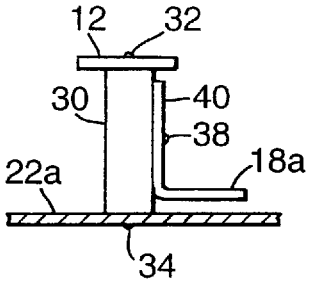

Referring now to FIGS. 2A, 2B and 2C, radiating system components of the radiating/receiving unit incorporating dipole radiator 12 are shown in greater detail, as typical of the configurations associated with each of dipole radiators 12–17. In FIGS. 2A, 2B and 2C relative dimensions have been modified or exaggerated for purposes of increased clarity of depiction of details. The views of FIGS. 2A and 2B correspond to the FIGS. 1A and 1B views of dipole radiator 12 and associated components, and FIG. 1C is an end view thereof.

As represented in FIGS. 2A, 2B and 2C, dipole radiator 12 is a rectangle of thin aluminum stock, or other appropriate conductive material, fastened to the top of a block 30 of dielectric, or other suitable insulative material, by screws 32 or other suitable fastening arrangement. Block 30 is attached to the surface of portion 22*a* of ground plane unit 22, by screws 34 or other suitable fastening arrangement. Also shown in these Figures. is the two-dimensional exciter resonator 40 extending perpendicularly in spaced relationship to the portion 22*a* of the ground plane unit. Exciter resonator 40, which is integrally formed with microstrip line section 18*a* of the signal distribution portion of the feed assembly, may be fastened to the side of block 30 by two screws 38 or other suitable fastening arrangement. As shown, line section 18*a* is positioned above ground plane portion 22*a* by a suitable support arrangement and is integrally formed (typically cut from thin, but structurally stiff, brass stock) in one piece with exciter resonator 40. As indicated, exciter resonator 40 is attached at a limited-width off-center common area 39 to line section 18*a*. After the combination of line section 18*a* and exciter resonator 40 is cut in one piece from the brass stock, exciter resonator 40 is structurally bent up to a position perpendicular or nominally perpendicular to microstrip line section 18*a* (and thereby also perpendicular or nominally perpendicular to the surface of ground plane portion 22*a*). In this embodiment, exciter resonators 41, 42, 43, 44 and 45, portions of which are visible in FIG. 1A extending from beneath dipole radiators 13–17 in FIG. 1A, are identical to exciter resonator 40. For present purposes, "nominally" means a quantity or relationship is within plus or minus thirty percent of a stated quantity or relationship. Also, "extending perpendicularly" means an element has a dimension along a perpendicular direction and a thin element extending perpendicularly has a principal dimension nominally aligned along a perpendicular direction.

With the foregoing description of the configuration of FIGS. 2A, 2B and 2C it will be seen that the antenna of FIGS. 1A, 1B and 1C is arranged for electromagnetic exciter feed of the dipoles 12–17 and includes a microstrip feed assembly positioned above ground plane unit 22. More particularly, the feed assembly includes a signal distribution portion and exciter resonators, the major portions of which may be cut from a single sheet of brass or other suitable material. As illustrated, the exciter resonators 40–45 are two-dimensional, having a planar rectangular form, the plane of which extends perpendicularly to the ground plane unit 22, and having an edge which is distal from unit 22 and extends parallel to the ground plane unit 22. The signal distribution portion 18 of the feed assembly is air-insulated from ground plane unit 22 and extends from an input/output point 48 to each of the exciter resonators 40–45. As shown, by appropriate proportioning and path lengths, signal distribution portion 18 is arranged to include an arrangement of six line section arms suitable to feed signals to the six exciter resonators 40–45 in parallel. By reciprocity, it will be understood that such arrangement is appropriate for coupling of received signals from the six exciter resonators to input/output point 48 during reception, as well as feeding signals to the exciter resonators during transmission. In the illustrated embodiment the signal distribution portion of the feed assembly was constructed of two pieces of brass stock soldered together at point 50. The upper part of the microstrip line portion 18 in the FIG. 1A depiction was formed in one piece with exciter resonators 40–45 attached.

Figure 3:
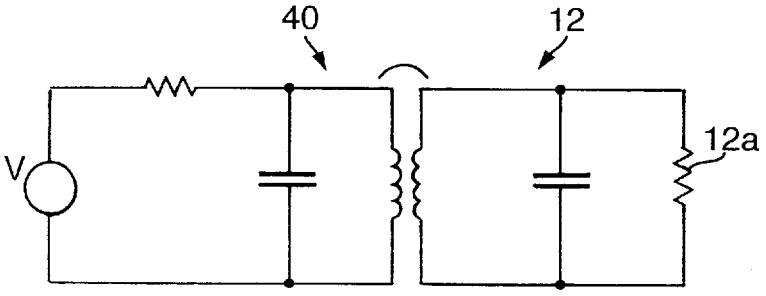
FIG. 3 illustrates the equivalent double-tuned circuit configuration providing electromagnetic coupling and broad band frequency characteristics of a dipole radiator/exciter resonator combination of the FIG. 1A antenna.

The electromagnetic exciter feed of the antenna is accomplished by the cooperative combination of the exciter resonators 40–45 with the dipole radiators 12–17, to form double-tuned radiating/receiving units. As shown and described, each of the dipole radiators is positioned in spaced non-contact relationship to one of the exciter resonators. Thus, with the exciter resonators 40–45 each extending normal to the ground plane, each of dipole radiators 12–17 aligned parallel to the ground plane is spaced from the upper edge of an exciter resonator. Each dipole radiator is dimensioned to function as a single-tuned circuit resonant at a frequency in the center of a frequency range of interest (normally the center of the operating frequency band of the antenna). Correspondingly, each exciter resonator is dimensioned to function as a resonant tuned circuit at a selected frequency (normally the same frequency as for the dipole radiators). The exciter resonator differs in not being a physically separate element, but being connected to and fed by the distribution portion of the feed assembly. The corresponding equivalent circuit configuration is represented in FIG. 3. As shown, the circuit of radiator 12 feeding radiation resistance 12*a* is coupled to the circuit of exciter resonator 40 fed by input signals from the feed assembly.

In operation, the exciter resonator (e.g., resonator 40) located with relatively close spacing to the conductive ground plane surface does not function as a radiator (except possibly to a negligible degree depending on actual dimensioning). With the close non-contact proximity however, the excitation of the exciter resonator is effective to cause signals to be electromagnetically coupled to the dipole radiator (e.g., dipole 12), which functions as an efficient radiator.

In an antenna constructed substantially as shown in FIGS. 1A, 1B and 1C, for operation in an 806–894 MHZ band, relevant dimensions were approximately as follows: typical dipole 12, 2"×5.2" rectangle of 0.063" aluminum sheet; typical exciter resonator 40, 2.5"×6" rectangle of 0.040" brass sheet; dipole spacing from ground plane, 3"; dipole to dipole spacing, 9"; dipole spacing from edge of associated exciter resonator, 0.10"; and antenna length, 4.6'. For vertical installation, this antenna was configured to provide an antenna pattern with a gain of approximately 13 dB, an azimuth beamwidth of approximately 105 degrees and an elevation beamwidth of approximately 15 degrees. In other configurations and applications antennas in accordance with the invention can be designed to provide antenna patterns of different azimuth beamwidth, by adjusting dipole spacing and ground plane width or configuration, and different elevation beamwidth, by using more or fewer dipoles, for example. The invention may also be applied for use with monopole type radiating elements as well known alternatives to dipoles. ANTENNAS OF FIGS. 4–6

Figure 4:
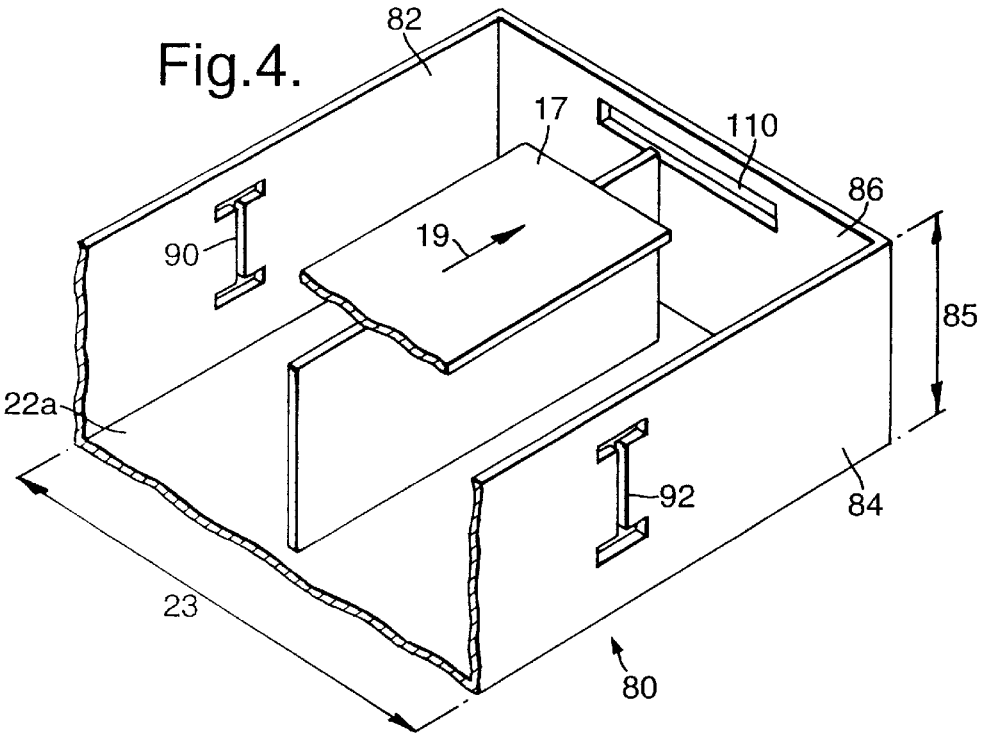
FIG. 4 shows a section of a cellular dipole array antenna including slot radiating elements for improved front-to-back performance, in accordance with the invention.

Referring now to FIG. 4, there is illustrated a portion of a cellular antenna utilizing the present invention in order to provide improved front-to-back performance. Consistent with established usage, front-to-back performance refers to the ratio of the amplitude of signals radiated forward along antenna boresight, as compared to the amplitude of signals radiated in a direction behind the antenna, typically at 180 degrees relative to boresight. The front-to-back ratio is a figure of merit for purposes of many antenna applications and, for present cellular antenna purposes, a typical objective of antenna performance can be to provide back signal amplitude 30 dB below boresight amplitude.

The antenna as shown in FIG. 1A is configured to provide an antenna pattern with an azimuth beamwidth of 105 degrees. In this configuration, reflective backwall 22 is flat, rectangular and approximately 7 inches wide, with edges turned backward. For a different application, in order to provide an antenna exhibiting an azimuth beamwidth of 90 degrees, the antenna construction illustrated in FIG. 4 is used in accordance with the invention. FIG. 4 is a simplified isometric view of one end of an antenna 80, which has the form of the FIG. 1A antenna modified to include a backwall 22*a* having wider edge portions which have been bent forward to form sidewalls 82 and 84, and endwall 86.

More particularly, FIG. 4 illustrates an embodiment of the present invention comprising a cellular antenna having improved front-to-back performance. As shown, the FIG. 4 antenna includes a plurality of vertically aligned dipoles 12–17 as described above, only one of which (dipole 17) is visible in the partial view of FIG. 4. The dipoles are arranged in a single column, which is typically intended to be positioned vertically during operational use of the antenna.

The FIG. 4 antenna also includes a reflective backwall 22*a* positioned behind the dipole radiators and having a width 23 which is inadequate to achieve the desired 90 degree azimuth beamwidth. As already noted, the 7 inch width of backwall 22 of the FIG. 1A antenna is designed to provide an azimuth beamwidth of 105 degrees, and is thereby of inadequate width to provide the amount of azimuth focus necessary to meet the 90 degree beamwidth objective of the FIG. 4 antenna. The FIG. 4 antenna reflector configuration is enhanced by inclusion of left and right sidewalls 82 and 84, respectively. Sidewalls 82 and 84 are each of planar rectangular shape and extend forward from the backwall 22*a*. Endwalls, one of which is shown at 86, are similar to and adjoin sidewalls 82 and 84 along respective forward extending side edges, which may be electrically coupled or slightly spaced apart. Backwall 22*a*, sidewalls 82 and 84 and the endwalls may be formed from a single sheet of aluminum stock with the sidewalls and endwalls bent forward to provide the illustrated configuration. In the FIG. 4 embodiment the forward dimension, or width, 85 of the sidewalls and endwalls is approximately 3 inches.

The FIG. 4 antenna further includes a plurality of slot radiating elements, illustrated as H-shaped slots 90 and 92, extending through sidewalls 82 and 84, respectively. As shown, in this embodiment a single H-shaped slot is centered in each of the sidewalls 82 and 84 adjacent to dipole radiator 17 (with additional slots adjacent to the other dipole radiators 12–16 not shown in FIG. 4). As will be further discussed, each of slots 90 and 92 is dimensioned and positioned (e.g., relative to the H-field of dipole 17 indicated at 19) to perform as a slot radiator excited by signals from dipole 17 and radiating outward from the conducting surface of the sidewall in a manner typical of known types of slot radiators. Slot radiating elements 90 and 92 are thus re-radiating slots effective to re-radiate signals behind the FIG. 4 antenna to partially cancel signals otherwise radiated behind the antenna. As will be further described with reference to FIG. 5, slot radiating element 92 re-radiates signals outwardly from side wall 84, including a level of signals re-radiated in a direction of interest behind the antenna which are phased for cancellation of signals (e.g., diffracted signals) otherwise radiated in the same direction in operation of the antenna. While signals are also re-radiated in other directions by slot radiating element 92, the effects of such signals are generally not significant with respect to overall operating performance of the antenna, (particularly in view of other signal magnitudes in such other directions). The signals re-radiated in directions other than behind the antenna may thus typically be ignored in respect to effects on antenna performance.

It will be appreciated that, if a basic antenna exhibits a front-to-back ratio with signal amplitude 23 dB down in a rear direction, by further reducing (by signal cancellation) the rear radiation a significant benefit can be achieved. Thus, by partial cancellation of the already low level back radiation, an additional 7 dB signal reduction can provide a front-to-back ratio of 30 dB.

Achievement of front-to-back performance of this order is a significant advantage in cellular and other applications.

Figure 5:
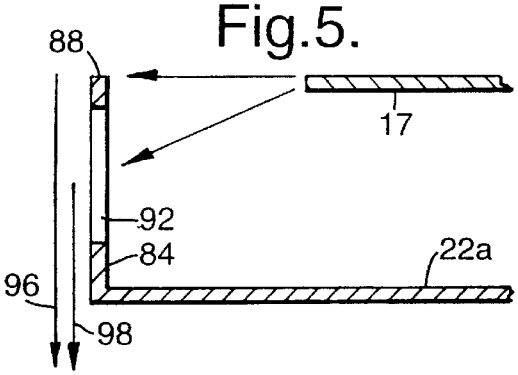
FIG. 5 is a ray diagram useful in describing signal cancellation for improved front-to-back performance in accordance with the invention.

With reference to FIG. 5, performance of slot 92 is illustrated based on simplified ray analysis. FIG. 5 is a simplified cross-sectional representation traversing dipole 17, a portion of backwall 22*a*, sidewall 84, and slot radiating element 92. FIG. 5 and other drawings are not necessarily to scale, since some dimensions are distorted for clarity of presentation. As described above, sidewall 84 is included as a forward extending portion of a reflector assembly including backwall 22*a*, in order to achieve a 90 degree azimuth beamwidth while maintaining a narrow side-to-side antenna profile (e.g., a total width of 7 inches for operation within a 806 to 894 MHZ cellular band). With inclusion of sidewall 84, a portion of signals radiated by dipole 17 is diffracted from the forward edge 88 of sidewall 84 in a range of azimuth directions, including signals diffracted in the rearward direction as represented by vector 96. With inclusion of slot radiating element 92 in accordance with the invention, a portion of signals radiated by dipole 17 are re-radiated by element 92. Re-radiation from slot radiating element 92 includes signals re-radiated in a rearward direction as represented by vector 98. As will be appreciated, for signals of common direction at least partial cancellation will result if re-radiated signals 98 are of appropriate amplitude and opposite phase (e.g., 180 degrees out of phase) relative to signals otherwise radiated behind the antenna, as by diffraction, as indicated at 96.

In application of the invention, it has been determined that signals re-radiated by a slot radiating element, such as element 92, undergo a phase change of the order of +90 degrees. The vector 98 represents a rearward signal scattered off the forward edge 88 of sidewall 84, which undergoes a phase change of −45 degrees. Vector 98 represents a rearward signal re-radiated by slot 92. The ray path via slot 92, being closer to the antenna backwall formed by ground plane 22*a*, results in an additional phase lead of approximately 45 degrees. The result is a phase differential of approximately 180 degrees between signals represented by vectors 96 and 98.

The amplitude of the slot re-radiated signal represented by vector 98 is caused to have an appropriate amplitude to provide an effective level of cancellation of the undesired signal represented by vector 96. The amplitude of signal 98 is adjusted, by appropriate dimensioning and loading of slot 92, to typically be approximately equal to the amplitude of rearward diffracted signal 96. A significant slot signal amplitude is required, since the radiation pattern of the slot places maximum signal re-radiation in a direction perpendicular to side wall 84 and significantly reduced or minimum signal re-radiation in the direction of vector 98. In a presently preferred embodiment, an "H" shaped slot as illustrated is utilized to obtain an appropriate signal amplitude in the direction of vector 98 via a slot contained within the limited available height 85 of wall 84. The result is the desired improvement in front-to-back performance provided by partial cancellation of back radiation. As noted, signals are also diffracted and re-radiated in other directions which may or may not be subject to signal cancellation.

However, the higher signal strengths typically present in such other directions, and lower degree of concern regarding minimization of signal levels in such directions, reduce the relevance of the effects of such signals.

Figure 6:
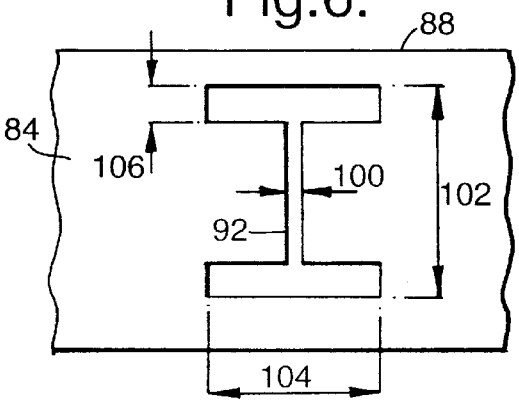
FIG. 6 shows a slot radiating element of the FIG. 4 antenna in greater detail.

FIG. 6 shows a typical form of slot 84 as provided in accordance with the invention. As shown in FIG. 4, slot 92 is H-shaped and aligned with its central portion extending in a forward direction (e.g., in the boresight direction), which is transverse to the array of dipole radiators (shown more fully in FIG. 1A) which is intended for use as a vertically aligned array in typical applications. As illustrated in FIG. 6, for operation within an 800 to 900 MHZ bandwidth, slot radiating element 92 has the form of an opening extending through sidewall 84 with a basic slot width 100 of 0.05 inches. In this embodiment, overall height 102 is approximately 2 inches, with the end portions of the H-shape each having a width 104 of approximately 1.75 inches and a dimension 106 of about 0.50 inches. For effective signal cancellation path length, the top edge of slot radiating element 92 was approximately 0.16 inches spaced from the forward edge 88 of sidewall 84.

Slot radiating elements suitable for re-radiating signals for signal cancellation pursuant to the invention can be provided in a variety of forms and sizes as applicable to particular applications. Rather than the described H-shape, in other applications a sidewall slot radiating element may more resemble a T or other shape. To provide an appropriate capacitance to achieve desired characteristics of re-radiated signals, a slot radiating element may have dielectric material introduced in or adjacent to the slot. For example, as shown in FIGS. 1B and 1C, the illustrated antenna includes a dielectric radome 24 including dielectric sidewalls. With the presence of reflective sidewalls 82 and 84 of FIG. 4 (which may be formed on a unitary basis with backwall 22, in substitution for the back extending skirt portion of reflector 22 visible in FIG. 1B) the radome sidewalls will overlay the reflective sidewalls 82 and 84. With sidewall portions of the dielectric radome 22 thus positioned adjacent to the slot radiating elements 90 and 92, the radome dielectric will partially determine effective slot capacitance and resonant frequency. The dielectric loading effect thus provided is taken into consideration in design and operating analysis of elements 90 and 92.

Discussion above has addressed placement of slot radiating elements in forward extending sidewalls. With a six dipole vertical array as in the FIG. 1A antenna, the level of signals radiated behind the antenna via the top and bottom ends of the antenna will typically not be a matter of concern. However, a FIG. 4 type antenna consisting of only a single dipole radiator may be appropriate in a particular application. In such an embodiment, as well as in particular multi-radiator applications, slot radiating elements can be provided in end walls for back radiation cancellation in the same manner as for sidewall slot radiating elements. As illustrated in FIG. 4, endwall slot radiating element 110 comprises a side-to-side slot of appropriate dimensions and placement to achieve a level of cancellation of backward radiated signals. In the case of endwall slot radiating element 110, excitation is by E-field vector across the narrow dimension of element 110, whereas for element 92 of FIG. 6 excitation is by H-field vector across dimension 100, in accordance with established antenna practice and theory.

Figure 7:
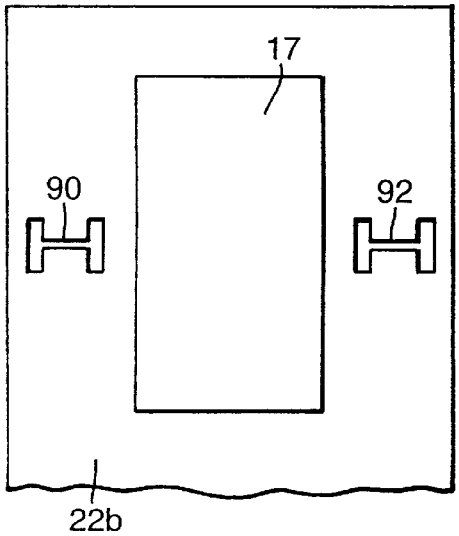
FIG. 7 illustrates an alternative form of antenna in accordance with the invention, including laterally extending reflector sections with slot radiating elements.

FIG. 7 illustrates a form of antenna wherein sidewall sections are effectively folded flat to extend outward from the back reflector on a co-planar basis to form a unitary planar reflective surface 22*b*. In view of the above-described objectives of limiting antenna width for wind loading and other considerations, an antenna may be constructed with a planar (or other shape) antenna wide enough to achieve a desired azimuth beamwidth, but still be subject to excessive back radiation, as from edge diffraction. In accordance with the invention, slot radiating elements extending through the reflector may be provided to improve front-to-back performance by cancellation of signals otherwise radiated behind the antenna. As shown in FIG. 7, slot radiating elements 90 and 92 extend through side portions of planar reflector 22*b*. In view of the preceding description, slot radiating elements 90 and 92 are appropriately dimensioned and positioned to provide partial cancellation of back radiated signals in accordance with the invention.

Figure 8:
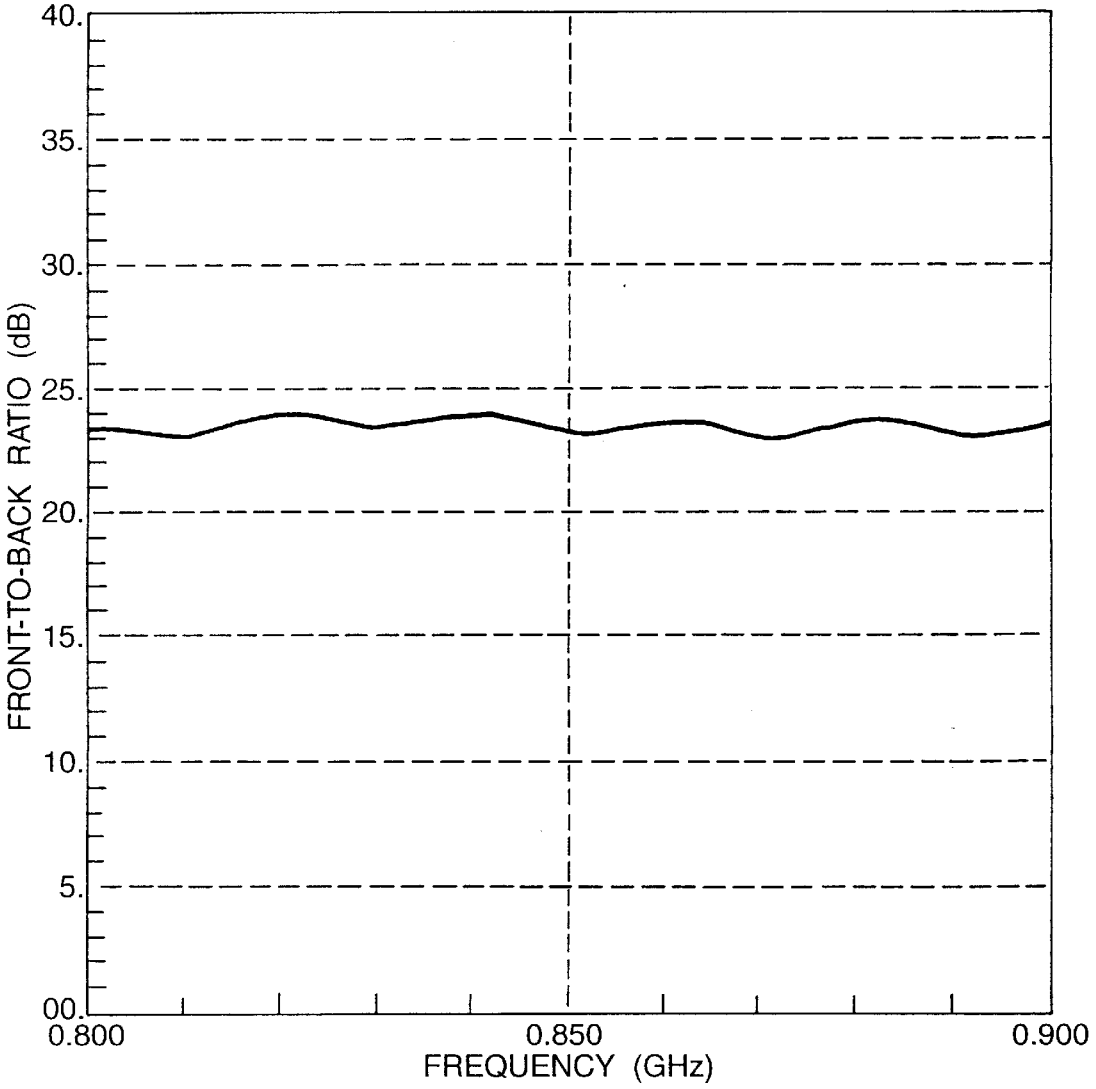
FIG. 8 is a plot of front-to-back ratio versus signal frequency, as measured for a FIG. 4 type antenna using the invention.
Figure 9:
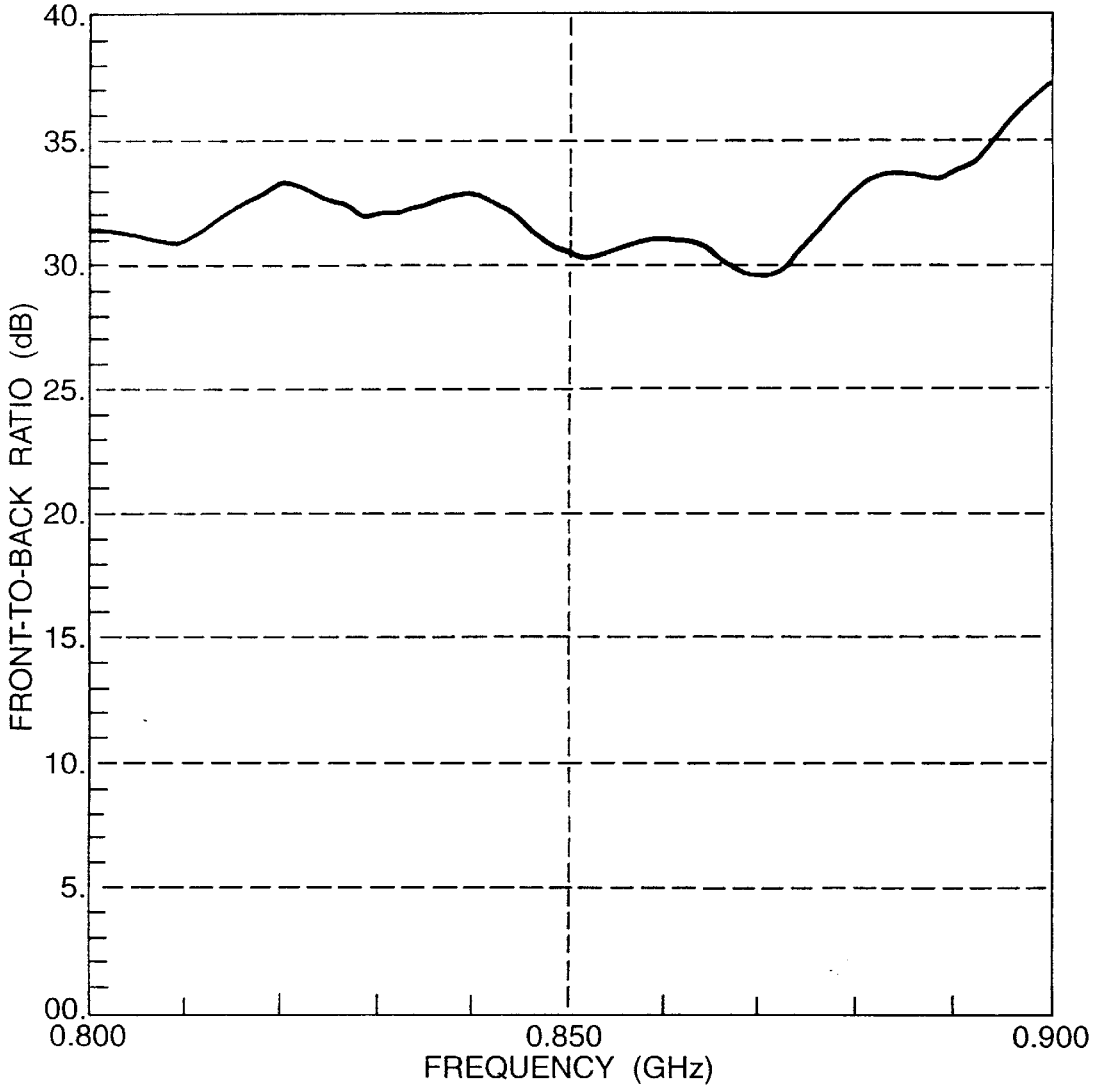
FIG. 9 is a similar plot showing data for a FIG. 4 type antenna including a radome.

FIG. 8 is a plot of test data for a FIG. 4 type antenna not employing slot radiating elements in accordance with the invention. Frequency in GHz is plotted horizontally and front-to-back ratio in dB is plotted vertically. As shown, curve 120 represents operation across a band with a front-to-back ratio approximating a 23 dB differential in the absence of slot radiating elements. FIG. 9 shows similar data for a FIG. 4 type antenna including slot radiating elements in accordance with the invention and a radome (of the type shown on the antenna of FIGS. 1B and 1C). Curve 122 shows an approximately 30 dB front-to-back differential for an antenna design including two side-by-side H-shaped slot radiating elements in accordance with the invention in place of each H-shaped slot radiating element in FIG. 4.

While there have been described the currently preferred embodiments of the invention, those skilled in the art will recognize that other and further modifications may be made without departing from the invention and it is intended to claim all modifications and variations as fall within the scope of the invention.

What is claimed is:

1. A cellular antenna, providing an azimuth beamwidth and having improved front-to-back performance, comprising:

a plurality of vertically aligned dipole radiators in a single vertical column;

a reflective backwall positioned behind said dipole radiators and having a width inadequate to achieve said azimuth beamwidth;

sidewalls extending forward from said backwall to increase beam focus to achieve said azimuth beamwidth; and a plurality of slot radiating elements formed in said sidewalls to re-radiate signals behind said antenna to partially cancel signals otherwise radiated behind said antenna.

2. A cellular antenna as in claim 1, additionally including a radome of dielectric material having side portions extending contiguous to said slot radiating elements and partially determining effective slot capacitance.

3. A cellular antenna as in claim 1, wherein each said slot radiating element is H-shaped and aligned with its central portion extending in a forward direction.

4. A cellular antenna as in claim 3, wherein each said slot radiating element includes a relatively narrow central portion providing a slot of predetermined capacitance and relatively wider end portions extending across the ends of the central portion.

5. A cellular antenna as in claim 1, wherein each said slot radiating element is proportioned to be non-resonant within an operating frequency band.

6. A cellular antenna as in claim 1, additionally including:

endwalls extending forward from the top and bottom of said backwall; and a plurality of slot radiating elements formed in said endwalls to re-radiate signals behind said antenna.

7. A cellular antenna as in claim 6, wherein each said endwall slot radiating element comprises a slot extending in a side-to-side direction.

8. A cellular antenna as in claim 6, wherein said plurality of dipole radiators is replaced by a single vertically aligned dipole radiator.

9. A cellular antenna as in claim 1, wherein said plurality of dipole radiators is replaced by a single vertically aligned dipole radiator.

10. A cellular Antenna as in claim 1, wherein said antenna provides a beam having a 90 degree azimuth beamwidth within a predetermined frequency range.

11. A cellular antenna as in claim 1, wherein the antenna is rotated so that said dipole radiators and column of radiators are not vertically aligned.

12. A cellular antenna, including a reflector with re-radiating slots to improve front-to-back performance, comprising:

a plurality of radiators arrayed in a vertical column;

said reflector cooperating with said radiators, said reflector including sidewall portions extending forward; and a plurality of slot radiating elements formed in said sidewalls to re-radiate signals behind said reflector to improve front-to-back performance by partially canceling signals otherwise radiated behind said antenna, said slot radiating elements proportioned to be non-resonant within an operating frequency band.

13. A cellular antenna as in claim 12, additionally including a radome of dielectric material having side portions extending contiguous to said slot radiating elements and partially determining effective slot capacitance.

14. A cellular antenna as in claim 12, wherein each said slot radiating element is H-shaped, and aligned with its central portion extending in a direction transverse to said array of radiators.

15. A cellular antenna as in claim 14, wherein each said slot radiating element includes a relatively narrow central portion providing a slot of predetermined capacitance and relatively wider end portions extending across the ends of the central portion.

16. A cellular antenna as in claim 12, wherein said radiators are vertically aligned dipole radiators.

17. A cellular antenna as in claim 12, wherein said plurality of radiators is replaced by a single vertically aligned dipole.

18. A cellular antenna as in claim 12, wherein the antenna is rotated so that said column of radiators are not vertically aligned.

19. A cellular antenna, providing an azimuth beamwidth and having improved front-to-back performance, comprising:

a plurality of vertically aligned dipole radiators in a single vertical column;

a reflective backwall of planar rectangular shape positioned behind said dipole radiators and having a width inadequate to achieve said azimuth beamwidth;

sidewalls of planar rectangular shape and extending forward from said backwall to increase beam focus to achieve said azimuth beamwidth; and a plurality of H-shaped slot radiating elements formed in said sidewalls to re-radiate signals behind said antenna to improve front-to-back performance by partially canceling signals otherwise radiated behind said antenna.

20. A cellular antenna as in claim 19, wherein each said slot radiating element includes a relatively narrow central portion providing a slot of predetermined capacitance and relatively wider end portions extending across the ends of the central portion.

21. A cellular antenna as in claim 19, additionally including a radome of dielectric material having side portions extending contiguous to said slot radiating elements and partially determining effective slot capacitance.

22. A cellular antenna as in claim 19, wherein said plurality of dipole radiators is replaced by a single vertically aligned dipole.

* * * * *